US008522678B2

(12) United States Patent
Liu et al.

(10) Patent No.: US 8,522,678 B2
(45) Date of Patent: Sep. 3, 2013

(54) STRAPPING MACHINE HAVING A MOVABLE WORKING ASSEMBLY

(75) Inventors: Chin-Chang Liu, Taichung (TW); Chi-Jan Su, Taipei (TW)

(73) Assignees: Tekpak Corporation, Taichung (TW); Transpak Equipment Corporation, Taipei (TW)

( * ) Notice: Subject to any disclaimer, the term of this patent is extended or adjusted under 35 U.S.C. 154(b) by 209 days.

(21) Appl. No.: 13/034,676

(22) Filed: Feb. 24, 2011

(65) Prior Publication Data

US 2012/0216688 A1 Aug. 30, 2012

(51) Int. Cl.
*B65B 13/18* (2006.01)
*F16M 7/00* (2006.01)

(52) U.S. Cl.
USPC ..... 100/13; 53/589; 100/7; 100/26; 100/29; 108/147; 108/147.19; 108/147.21; 144/285; 144/286.5; 144/286.1; 144/287; 248/669

(58) Field of Classification Search
USPC ..... 53/589; 100/7, 13, 26, 29; 108/147, 108/147.19, 147.21; 144/286.5, 286.1, 287, 144/285; 248/669
See application file for complete search history.

(56) References Cited

U.S. PATENT DOCUMENTS

| | | | | |
|---|---|---|---|---|
| 4,412,484 | A * | 11/1983 | Beethem et al. | 100/7 |
| 4,951,562 | A * | 8/1990 | Ribaldo | 100/8 |
| 6,904,841 | B2 * | 6/2005 | Bobren et al. | 100/13 |
| 6,951,170 | B2 * | 10/2005 | Lininger et al. | 100/26 |
| 6,990,895 | B2 * | 1/2006 | Powers | 100/27 |
| 7,421,944 | B1 * | 9/2008 | Flaum et al. | 100/3 |
| 7,428,865 | B1 * | 9/2008 | Kasel et al. | 100/3 |

* cited by examiner

*Primary Examiner* — Dana Ross
*Assistant Examiner* — Onekki Jolly
(74) *Attorney, Agent, or Firm* — Ming Chow; Sinorica, LLC

(57) ABSTRACT

A strapping machine having a movable working assembly includes comprises a machine body, a chute, and a movable working assembly. This machine body contains a storing space. The chute has an upper chute portion and a lower chute portion. The movable working assembly which is in the storing space includes a horizontal movable portion, a vertical movable portion, a working device, and an operation linkage mechanism. When the vertical movable portion moves to the move-down position, the lower chute portion is separated from the upper chute portion. Then, the movable working assembly can be moved out for easy maintenance. So, it is quick and easy to repair any internal device or part inside the strapping machine. The repairer does not need to stoop or squat down for repairing it. In addition, it saves strength and time to move out the working device or related part.

1 Claim, 6 Drawing Sheets

STRAPPING MACHINE HAVING A MOVABLE WORKING ASSEMBLY

BACKGROUND OF THE INVENTION

1. Field of the Invention

The present invention relates a strapping machine having a movable working assembly. Particularly, it relates to a strapping machine having a movable working assembly for easy maintenance. In which, it is quick and easy to repair any internal device or part inside the strapping machine. The repairer does not need to stoop or squat down for repairing it. In addition, it saves strength and time to move out the working device or related part.

2. Description of the Prior Art

Referring to FIGS. 5 and 6, the traditional strapping machine includes a base 91, a chute frame 92, a sealing/cutting mechanism 93, and a strap supply 94. There is a maintenance door 95 disposed on the base 91 for a user (or a repairer) to replace a new strap, to inspect the machine, or to repair some parts. The function of this sealing/cutting mechanism 93 is to provide a strap (from the strap supply 94 to the chute frame 92) surrounding an object (not shown) and then to proceed the retreating, cutting, and heat sealing actions.

However, the sealing/cutting mechanism 93 is very complicated. It includes many internal parts, such as guiding rollers, electric motors, guiding rails, electric heater, controlling circuits, etc (these parts are omitted or simplified in the related figures). Once any internal part has a breakdown during operation, the user has to open the maintenance door 95 and then to squat down with stretching one's hand inside the machine for inspection. Therefore, the traditional one has the following drawbacks and problems:

[1] It is difficult to repair the internal devices or parts inside the traditional strapping machine. When an internal part of sealing/cutting mechanism 93 is out of order, the user has to detach the related parts in sequence from outside to inside. After which, the user needs to check which one is broken. Besides, once the repairing work is done, all these related parts have to be re-installed again. The whole process is time-consuming and troublesome. Therefore, the entire repairing work is quite difficult.

[2] The repairer has to stoop or squat down for repairing it. Because the user (or the repairer) has to stoop or squat down to reach the sealing/cutting mechanism 93 inside the base 91 (or other parts), its working efficiency is very low and it tends to cause the user's back pain or long-term poor posture related pain.

[3] It cannot take the sealing/cutting mechanism out. Because this seal/cutting mechanism 93 is fixed inside the base 91, it cannot be moved out.

SUMMARY OF THE INVENTION

The objects of the present invention are to provide a strapping machine having a movable working assembly. In which, it is quick and easy to repair any internal device or part inside the strapping machine. The repairer does not need to stoop or squat down for repairing it. In addition, it saves strength and time to move out the working device or related part. Therefore, this invention can solve the problems of the traditional one listed as follows. It is difficult to repair the internal devices or parts inside the traditional strapping machine. The repairer has to stoop or squat down for repairing it. Plus, it cannot take the sealing/cutting mechanism out.

In order to achieve the above mentioned objects, the present invention is provided. A strapping machine having a movable working assembly comprising:

a machine body including a controller, a working deck, a storing space, a door, and a horizontal securing portion, the working deck having a working opening, the storing space being beneath the working deck, the door being able to be opened so as to allow the storing space communicating with an external space; the horizontal securing portion being positioned in the storing space;

a chute having an upper chute portion and a lower chute portion, the upper chute portion being secured on the machine body;

a movable working assembly including:

(a) a horizontal movable portion having a horizontal moving portion and a vertical moving base; the horizontal moving portion connecting with the horizontal securing portion and having at least a move-in position and a move-out position;

(b) a vertical movable portion having a vertical moving portion and a working device supporting portion; the vertical movable portion which connects with the vertical moving base being movable on the horizontal movable portion vertically and being movable between a move-up position and a move-down position; when the vertical movable portion moving to the move-down position, the lower chute portion being separated from the upper chute portion and the lower chute portion of the chute being not blocked by the working deck; when the vertical movable portion moving to the move-up position, the upper chute portion and the lower chute portion being combined as a loop for guiding a strap to surround a working object;

(c) a working device fixed on the working device supporting portion for guiding the strap into the chute and proceeding a strap retracting action, a strap cutting action, and a strap sealing action; the lower chute portion being mounted on the working device;

(d) an operation linkage mechanism having a first rod, a central shaft portion, a second rod, and a central pivoting seat; the second rod connecting to the vertical movable portion, the central pivoting portion being pivoted with the central shaft portion; the first rod, the central shaft portion and the second rod being connected as an integral body; when the first rod being moved, the second rod being moved accordingly, so as to control the vertical movable portion moving between the move-up position and the move-down position;

after the door being open, the first rod is able to be rotated down so that the vertical movable portion moves from the move-up position to the move-down position, and then the horizontal movable portion is able to be moved from the move-in position to the move-out portion so as to make the working device is moved out from the storing space for easy maintenance.

DETAILED DESCRIPTION OF THE PREFERRED EMBODIMENT

Figure 1:
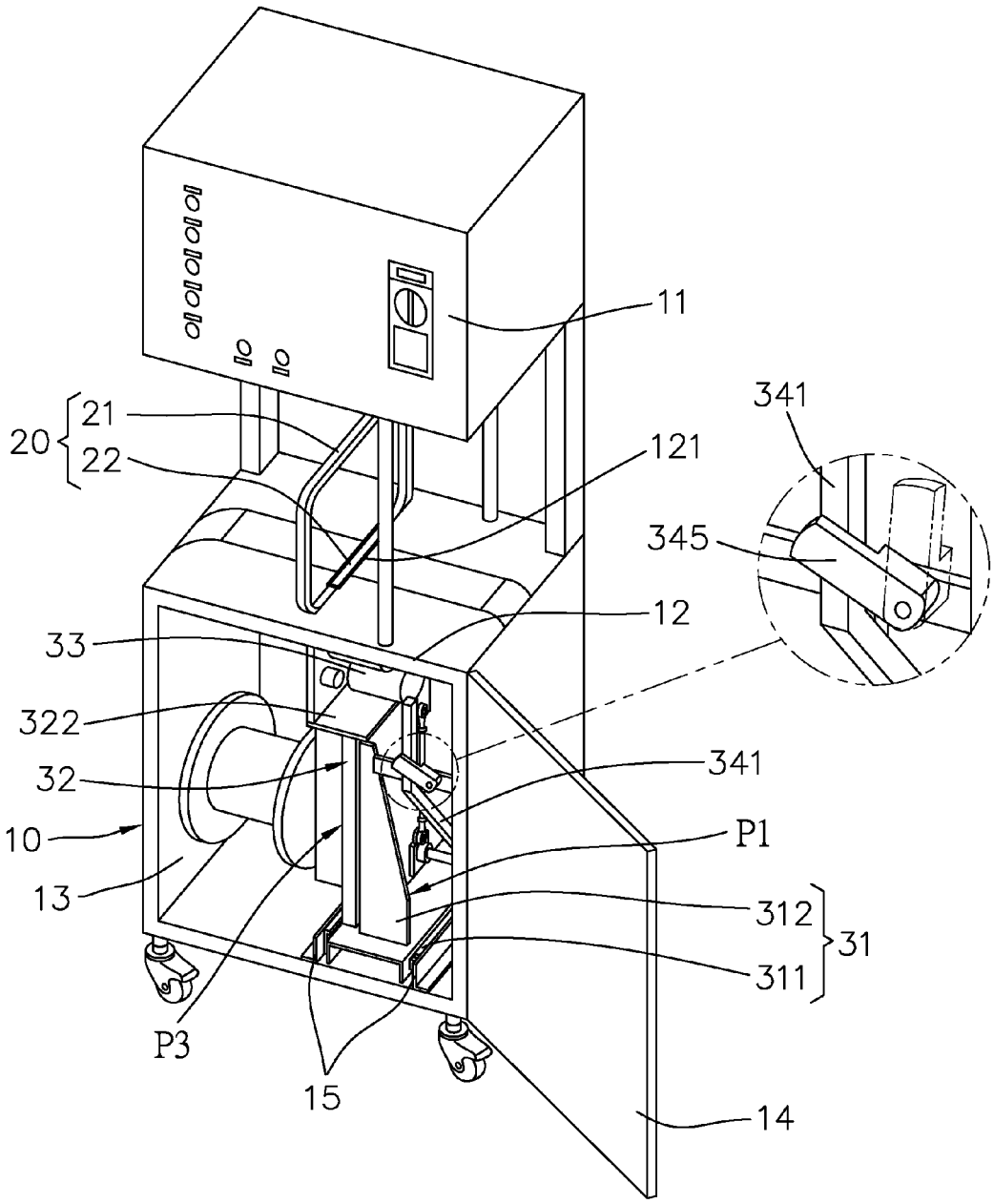
FIG. 1 is a perspective view of the present invention.
Figure 2:
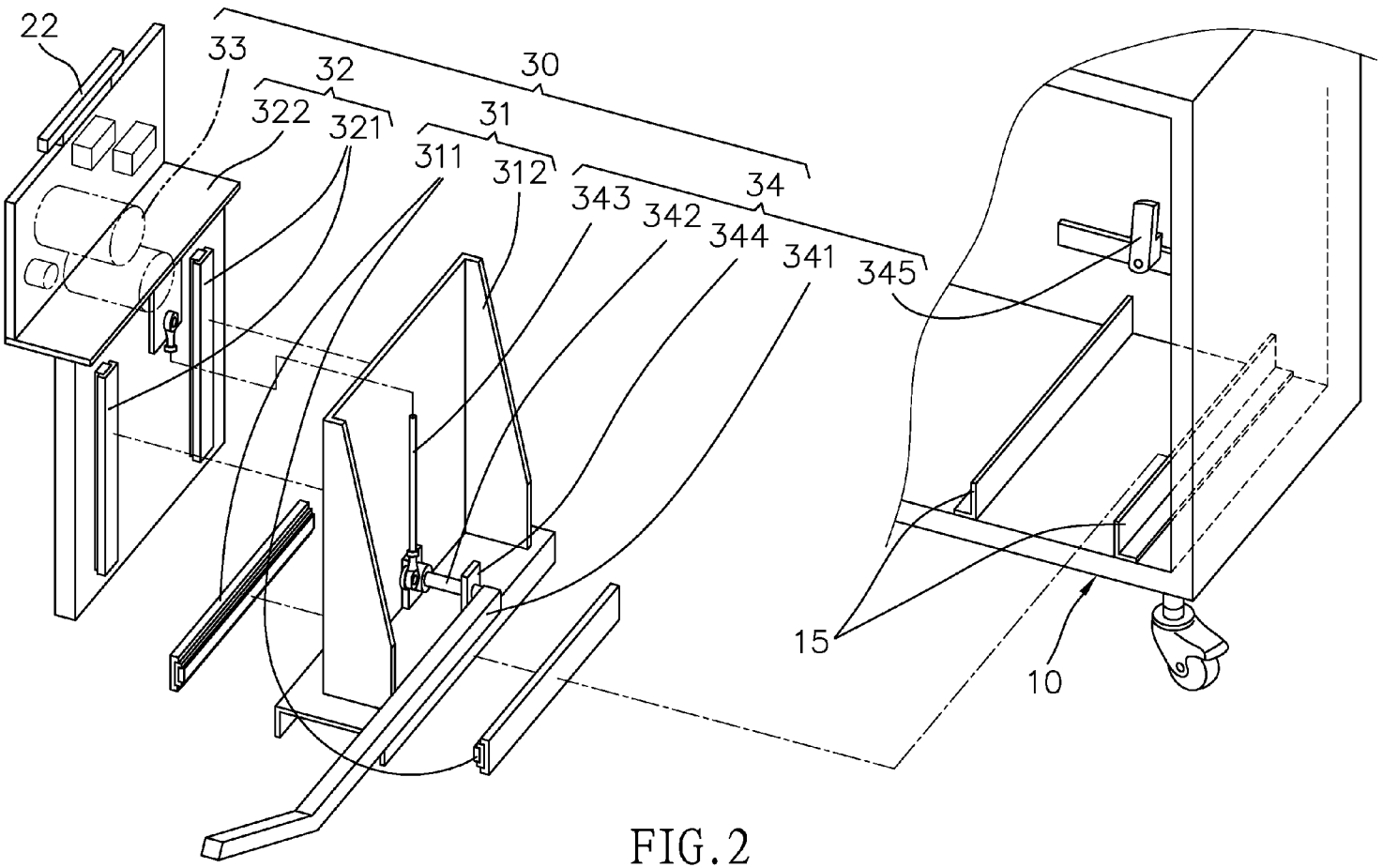
FIG. 2 is an exploded view of a portion of the present invention.

Referring to FIGS. 1 and 2, the present invention relates to a strapping machine having a movable working assembly. It mainly comprises a machine body 10, a chute 20, a movable working assembly 30.

With regard to said machine body 10, it includes a controller 11, a working deck 12, a storing space 13, a door 14, and a horizontal securing portion 15. This working deck 12 has a working opening 121. The storing space 13 is beneath the working deck 12. The door 14 is able to be opened so as to allow the storing space 13 communicating with an external space. The horizontal securing portion 15 is positioned in the storing space 13.

Concerning the chute 20, it has an upper chute portion 21 and a lower chute portion 22. The upper chute portion 21 is secured on the machine body 10.

About the movable working assembly 30, it includes a horizontal movable portion 31, a vertical movable portion 32, a working device 33, and an operation linkage mechanism 34.

Figure 3A:
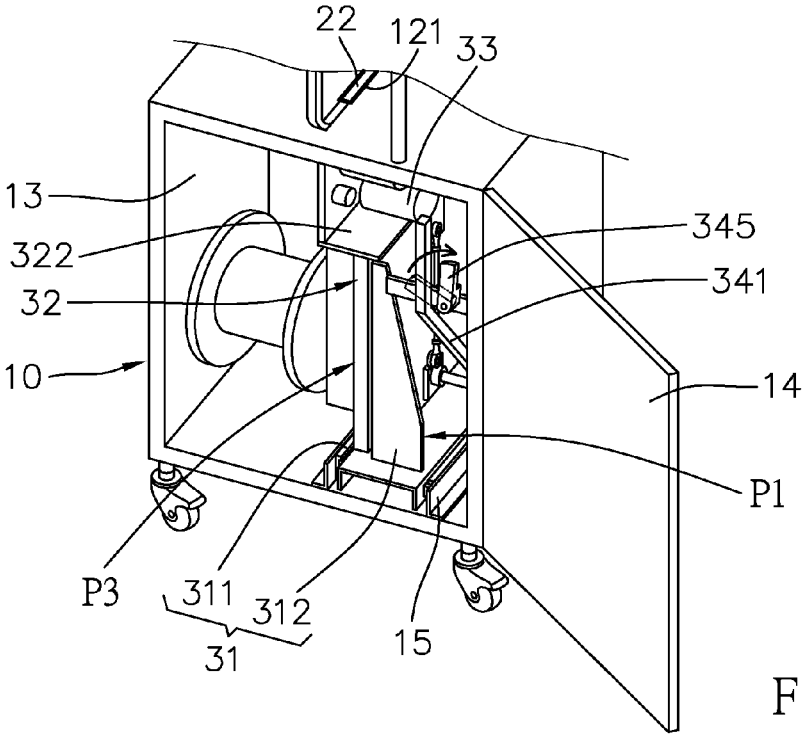
FIG. 3A is a view showing that the movable working assembly is inside.

[a] The horizontal movable portion 31 has a horizontal moving portion 311 and a vertical moving base 312. The horizontal moving portion 311 connects with the horizontal securing portion 15 so that the horizontal movable portion 31 can be moved on the machine body 10 horizontally. Also, the horizontal moving portion 311 has at least a move-in position P1 and a move-out position P2 (as illustrated in FIG. 3C).

[b] A vertical movable portion 32 has a vertical moving portion 321 and a working device supporting portion 322. The vertical movable portion 32 which connects with the vertical moving base 312 is movable on the horizontal movable portion 31 vertically. Plus, the vertical movable portion 32 is movable between a move-up position P3 and a move-down position P4 (referring to FIGS. 3A and 3B). Hence, when the vertical movable portion 32 moves to the move-down position P4, the lower chute portion 22 of the chute 20 is separated from the upper chute portion 21, and the lower chute portion 22 of the chute 20 is not blocked by the working deck 12. When the vertical movable portion 32 moves to the move-up position P3, the upper chute portion 21 and the lower chute portion 22 are combined together as a loop for guiding a strap to surround a working object.

[c] The working device 33 is fixed on the working device supporting portion 322 for guiding the strap into the chute 20 and for proceeding a strap retracting action, a strap cutting action, a strap sealing action, and the like. The lower chute portion 22 of the chute 20 is mounted on a predetermined position of the working device 33.

[d] An operation linkage mechanism 34 has a first rod 341, a central shaft portion 342, a second rod 343, and a central pivoting seat 344. The second rod 343 connects to the vertical movable portion 32. The central pivoting portion 342 is pivoted with the central shaft portion 342. The first rod 341, the central shaft portion 342 and the second rod 343 are connected as an integral body. When the first rod 341 is rotated, the second rod 243 being rotated accordingly, so as to control the vertical movable portion 32 moves between the move-up position P3 and the move-down position P4. Besides, the operation linkage mechanism 34 can further include a locking portion 34. When the first rod 341 moves to the upper portion P3, the locking portion 34 can lock the first rod 341 at the move-up position P3.

Figure 3B:
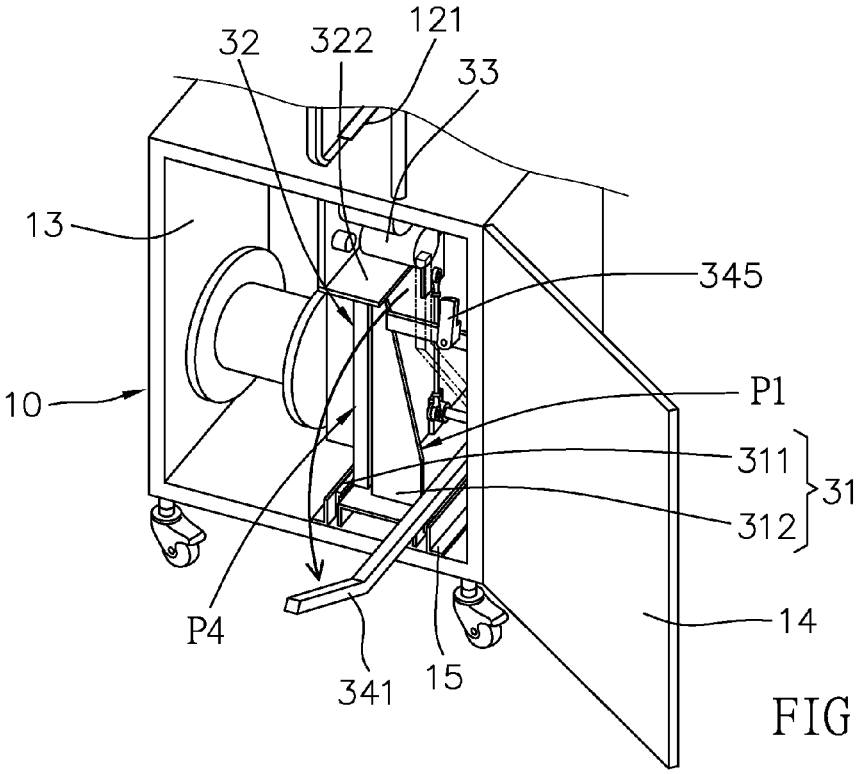
FIG. 3B is a view showing that the first rod is rotated down.
Figure 3C:
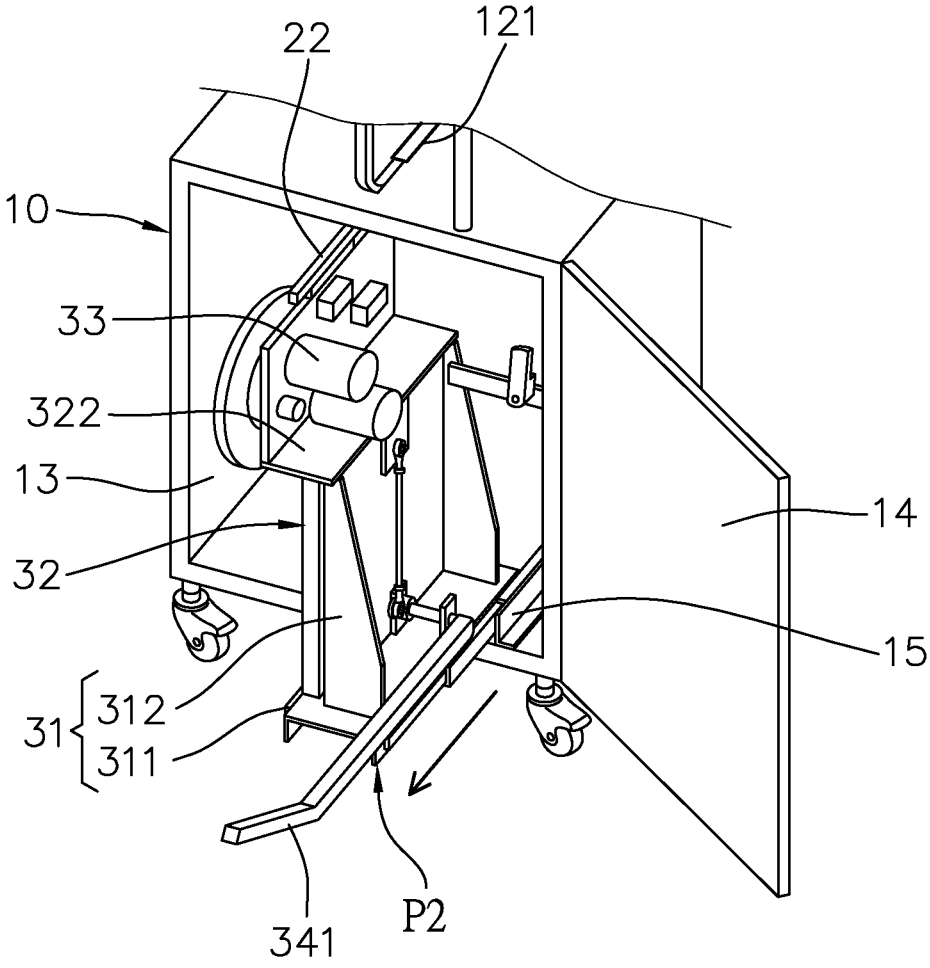
FIG. 3C is a view showing that the movable working assembly can be moved out.
Figure 4B:
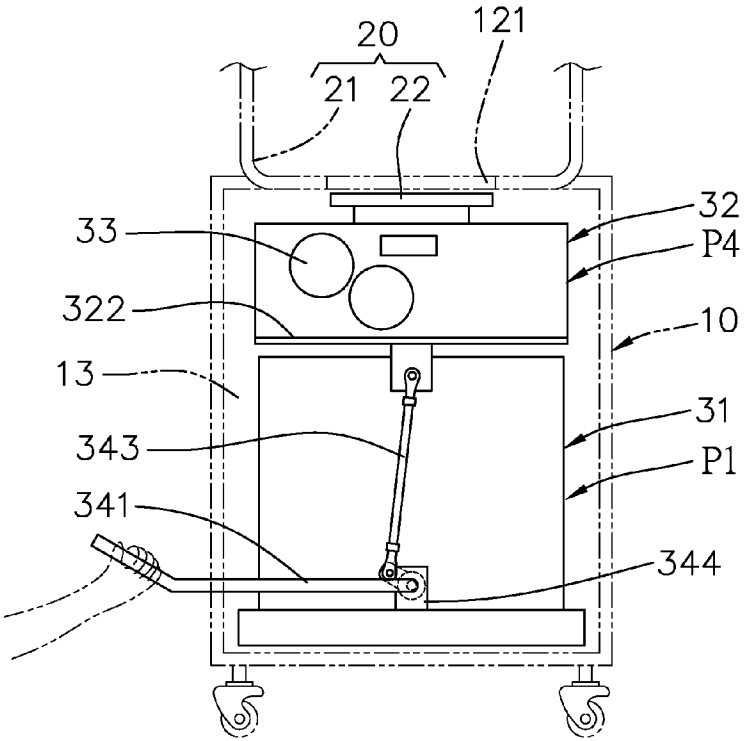
FIG. 4B illustrates the lower chute portion moved to the move-down position.
Figure 4A:
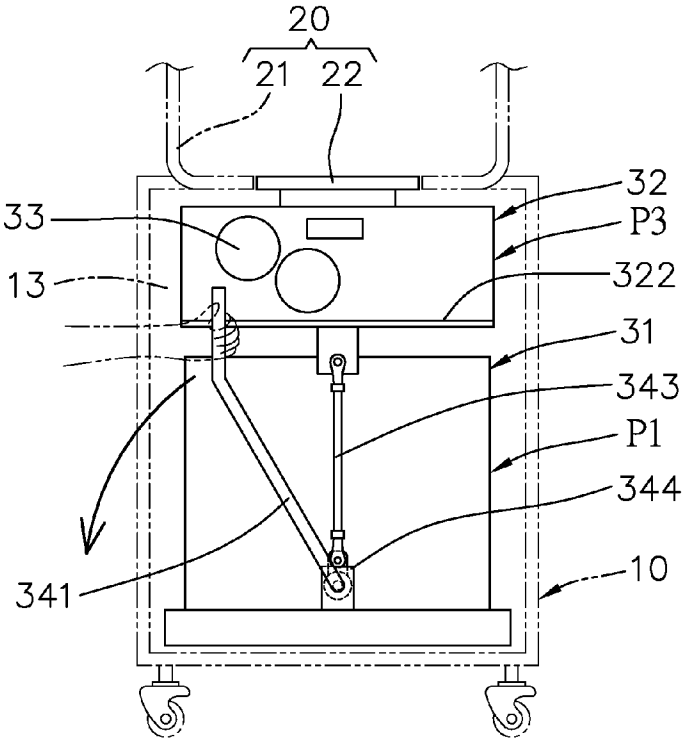
FIG. 4A illustrates the lower chute portion which is kept at the move-up position.
Figure 5:
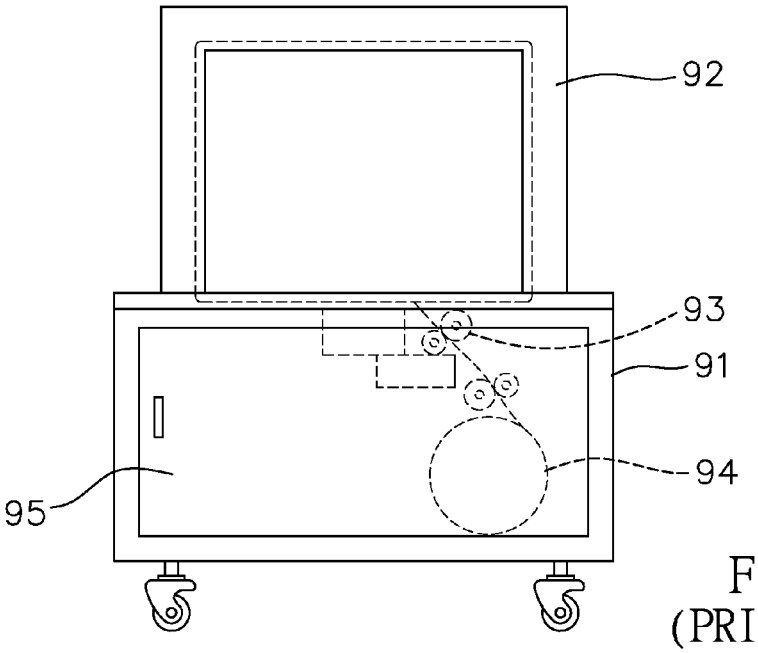
FIG.5 (PRIOR ART)
FIG. 5 is a view showing a traditional strapping machine.
Figure 6:
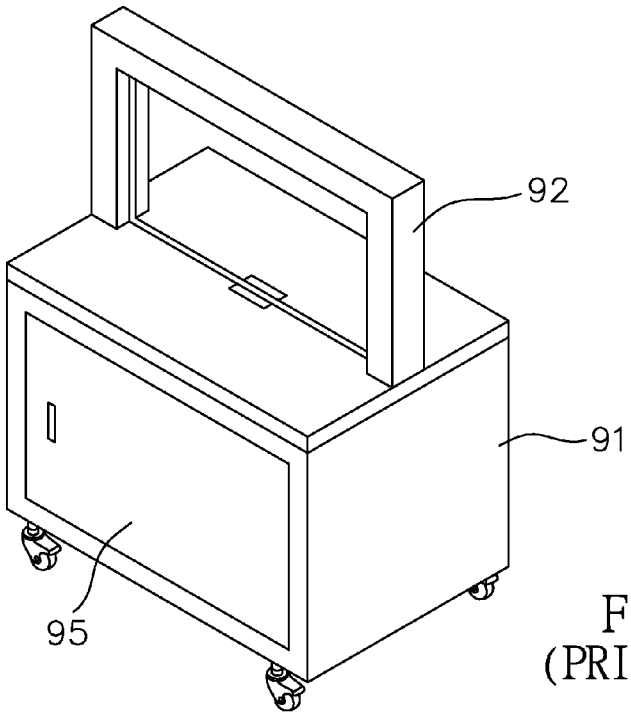
FIG.6 (PRIOR ART)
FIG. 6 is a perspective view of the traditional strapping machine.

Therefore, after the door 14 is open (as exhibited in FIG. 3A), the first rod 341 is able to be rotated down so that the vertical movable portion 32 moves from the move-up position P3 to the move-down position P4 (as shown in FIGS. 3B, 4A and 4B). Then, this horizontal movable portion 31 is able to be moved from the move-in position P1 to the move-out portion P2 (as illustrated in FIG. 3C) so as to make the working device 33 is moved out from the storing space 13 for easy maintenance.

As shown in FIGS. 4A and 4B, when the first rod 341 is rotated down by a user, this vertical movable portion 32 moves from the move-up position P3 to the move-down position P4. Meanwhile, the lower chute portion 22 of the chute 20 is moves down. Hence, the lower chute portion 22 of the chute 20 is not blocked by the working deck 12. Under this condition, the working device 33 can be moved out from the storing space 13 (the horizontal movable portion 31 moves to the move-out position P2).

By the way, when the use needs to repair or replace some parts, this user only needs to open the door 14 and then rotate down the first rod 341. Then, it is possible and easy to move the working device 33 from the storing space 13. This operation is extremely convenient and easy.

The advantages and functions of this invention can be summarized as follows.

[1] It is quick and easy to repair any internal device or part inside the strapping machine. The present invention has a moveable working assembly which can be moved vertically and horizontally. When the user needs to repair any device or part (such as the working device 33), the user can open the door 14 and then rotate the vertical movable portion 32 of the movable working assembly 30 down. After which, the horizontal movable portion 31 can be moved out horizontally. Therefore, it is very easy to repair, inspection, or replacement. Thus, it is quick and easy to repair any internal device or part inside the strapping machine.

[2] The repairer does not need to stoop or squat down for repairing it. Because the movable working assembly 30 can be lowered down and then be moved out horizontally, the height of the movable working assembly 30 will be roughly around one-third to on half of a repairer who has an average height. Thus, the repairer does not need to stoop or squat down for repairing it.

[3] It saves strength and time to move out the working device or related part.

Based on the principle of leverage, the length of the first rod 341 of the operation linkage mechanism 34 is longer, it will save more strength during operation. The entire vertical movable portion 32 and the working device 33 can be move up easily. Its operation is quick and not painful.

While this invention has been particularly shown and described with references to the preferred embodiments thereof, it will be understood by those skilled in the art that various changes or modifications can be made therein without departing from the scope of the invention by the appended claims.

The invention claimed is:

1. A strapping machine having a movable working assembly comprising:

a machine body including a controller, a working deck, a storing space, a door which is rotatable substantially along a Z-axis, and a horizontal securing portion, said working deck having a working opening, said storing space being beneath said working deck, said door being able to be opened so as to allow said storing space communicating with an external space; said horizontal securing portion being positioned in said storing space;

a chute having an upper chute portion and a lower chute portion, said upper chute portion being secured on said machine body;

a movable working assembly including:

(a) a horizontal movable portion having a horizontal moving portion and a vertical moving base; said horizontal moving portion connecting with said horizontal securing portion and having at least a move-in position and a move-out position;

(b) a vertical movable portion having a vertical moving portion and a working device supporting portion; said vertical movable portion which connects with the vertical moving base being movable on said horizontal movable portion vertically and being movable between a move-up position and a move-down position; when said vertical movable portion moving to said move-down position resulting said lower chute portion leaving from said working opening, said lower chute portion being separated from said upper chute portion and said lower chute portion of said chute being not blocked by said working deck; when said vertical movable portion moving to said move-up position resulting said lower chute portion moving toward said opening, said upper chute portion and said lower chute portion being combined as a loop for guiding a strap to surround a working object;

(c) a working device fixed on said working device supporting portion for guiding said strap into said chute and proceeding a strap retracting action, a strap cutting action, and a strap sealing action; said lower chute portion being mounted on said working device; and (d) an operation linkage mechanism which is beneath said fixed working deck having a first rod, a central shaft portion, a second rod, and a central pivoting seat; said second rod connecting to said vertical movable portion, said central pivoting portion being pivoted with said central shaft portion; said first rod, said central shaft portion and said second rod being connected as an integral body; when said first rod being moved, said second rod being moved accordingly, so as to control said vertical movable portion moving between said move-up position and said move-down position;

after said door being open, said first rod is able to be rotated down so that said vertical movable portion moves from said move-up position to said move-down position, and then said horizontal movable portion is able to be moved from said move-in position to said move-out portion so as to make said working device is moved out from said storing space for easy maintenance, wherein said operation linkage mechanism further including a locking portion, when said first rod moves to said upper portion, said locking portion is able to lock said first rod at said move-up position.

* * * * *